United States Patent [19]

Lanphear

[11] 4,135,689

[45] Jan. 23, 1979

[54] RIGID CHAIN SYSTEM FOR CONSTRUCTING ARTICLES

[76] Inventor: Marvin P. Lanphear, 938 S. Second St., Pocatello, Id. 83201

[21] Appl. No.: 616,878

[22] Filed: Sep. 25, 1975

[51] Int. Cl.[2] ..... F16M 11/20

[52] U.S. Cl. ..... 248/188.1; D6/74

[58] Field of Search ..... 248/188.1, 188.8; D6/20, 68, 74, 151, 146, 147, 177; 256/35; 297/445

[56] References Cited

U.S. PATENT DOCUMENTS

| | | | |
|---|---|---|---|
| D. 116,282 | 8/1939 | Dillon | D6/74 |
| D. 169,948 | 6/1953 | Quintana | D6/74 |
| D. 179,527 | 1/1957 | Rubin | D6/147 |
| D. 230,231 | 2/1974 | Merritt | D6/151 |
| 2,199,518 | 5/1940 | Coleman | 256/35 |
| 2,936,009 | 5/1960 | McGuire | 297/445 |
| 2,999,662 | 9/1961 | Lappin et al. | 248/188.1 |

FOREIGN PATENT DOCUMENTS

| | | | |
|---|---|---|---|
| 529686 | 11/1940 | United Kingdom | 248/188.8 |

*Primary Examiner*—Robert A. Hafer

*Attorney, Agent, or Firm*—Clarence A. O'Brien; Harvey B. Jacobson

[57] ABSTRACT

The vertical posts, legs or columns of different articles of furniture are formed from chain-like link sections that are rigidly interconnected and made from a single piece. Horizontal elements are interconnected at selected heights to the vertical columns and may include rigid chain-like link sections similar in construction to the vertical columns.

11 Claims, 12 Drawing Figures

Fig. 1
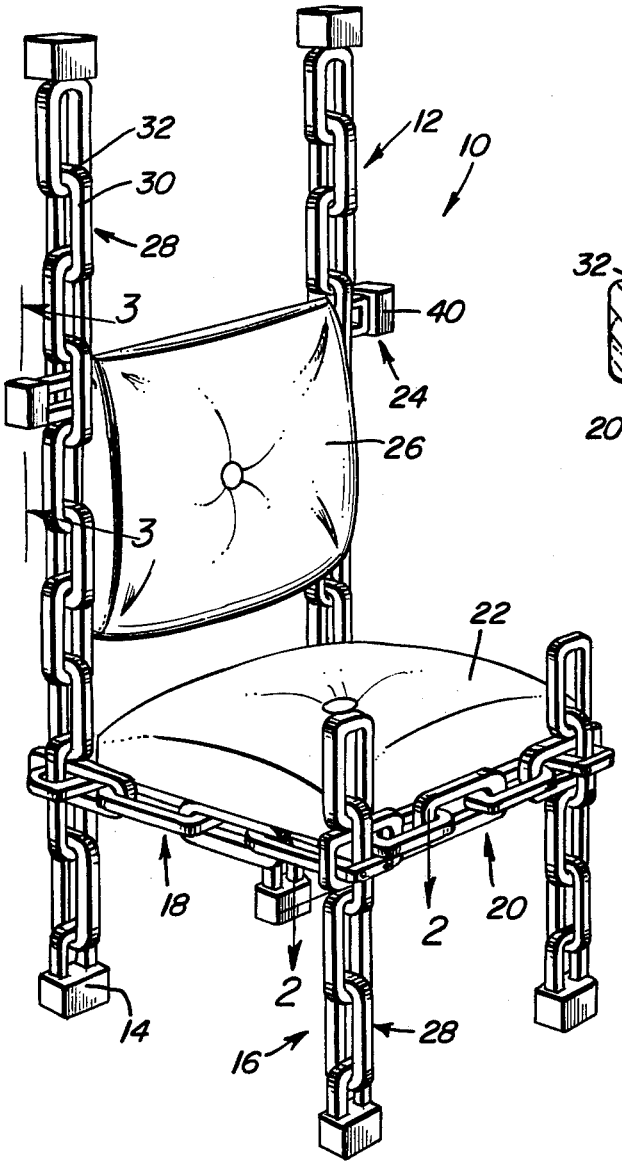
Fig. 2
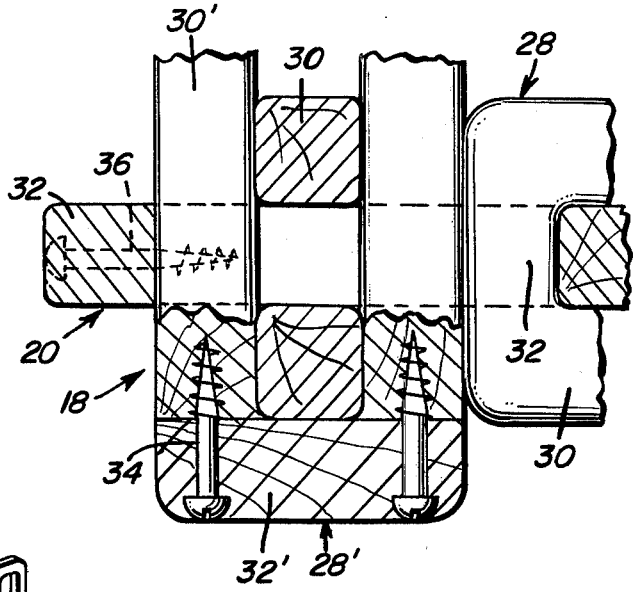
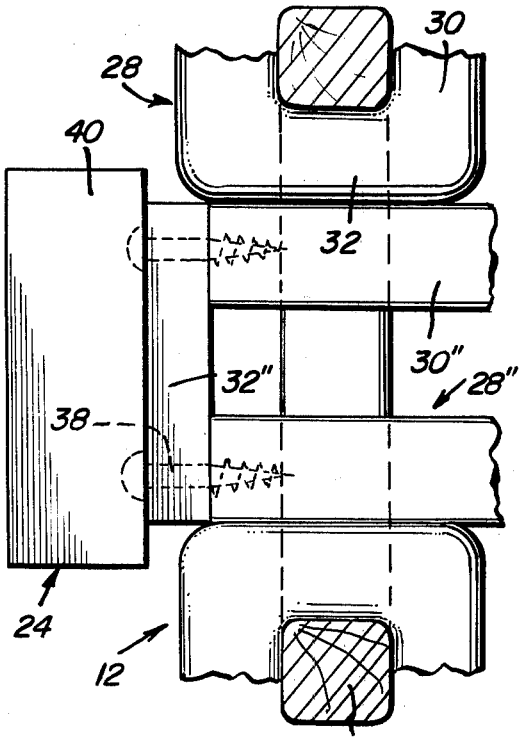
Fig. 3
Fig. 11
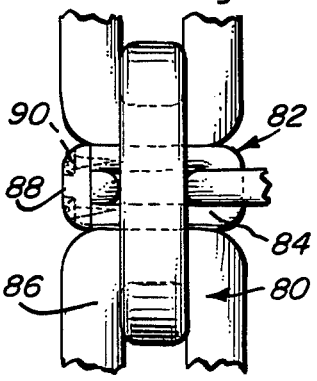
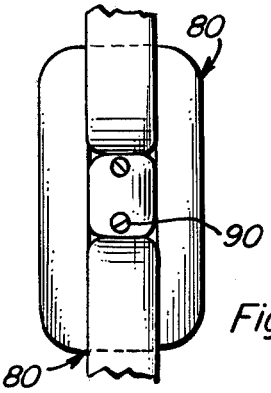
Fig. 12

RIGID CHAIN SYSTEM FOR CONSTRUCTING ARTICLES

This invention relates to the construction and assembly of different types of articles which include vertical columns such as the legs of furniture and the posts of fences.

The assembly of articles of furniture or the like from standard structural elements is well known as disclosed for example in U.S. Pat. Nos. Des. 169,948, 1,150,783, 3,131,970, 3,146,029 and 3,570,418. However, none of the foregoing patents discloses vertical columns or posts utilized in the construction of different types of articles and accommodating selected height connections for horizontal elements of different types and dimensions. It is therefore an important object of the present invention to provide a vertical column construction for articles of furniture or the like that is very versatile in use.

In accordance with the present invention, different articles of furniture for example, which include a plurality of vertical columns, legs or posts, are assembled relative to the vertical columns which are made of a plurality of rigidly interconnected, chain-like link sections. Bearing blocks are connected to the lowermost links while horizontal elements interconnect the vertical columns or posts. The horizontal elements may be in the form of slide runners for drawers, rails and may also be formed from chain-like link sections similar in construction to the vertical columns themselves. The horizontal elements may therefore be interconnected with the vertical columns at different selected heights by means of end link sections having separable bridging portions held assembled in embracing relationship to the column by means of fasteners.

These together with other objects and advantages which will become subsequently apparent reside in the details of construction and operation as more fully hereinafter described and claimed, reference being had to the accompanying drawings forming a part hereof, wherein like numerals refer to like parts throughout.

FIG. 1 is a perspective view of a typical piece of furniture such as a chair constructed in accordance with the present invention.

FIG. 2 is an enlarged partial sectional view taken substantially through a plane indicated by section line 2—2 in FIG. 1 with parts broken away and shown in section.

FIG. 3 is an enlarged partial sectional view taken substantially through a plane indicated by section line 3—3 in FIG. 1.

FIG. 11 is a partial elevation view of a constructional modification in accordance with the present invention.

FIG. 12 is an end view of the construction shown in FIG. 11.

Figure 4:
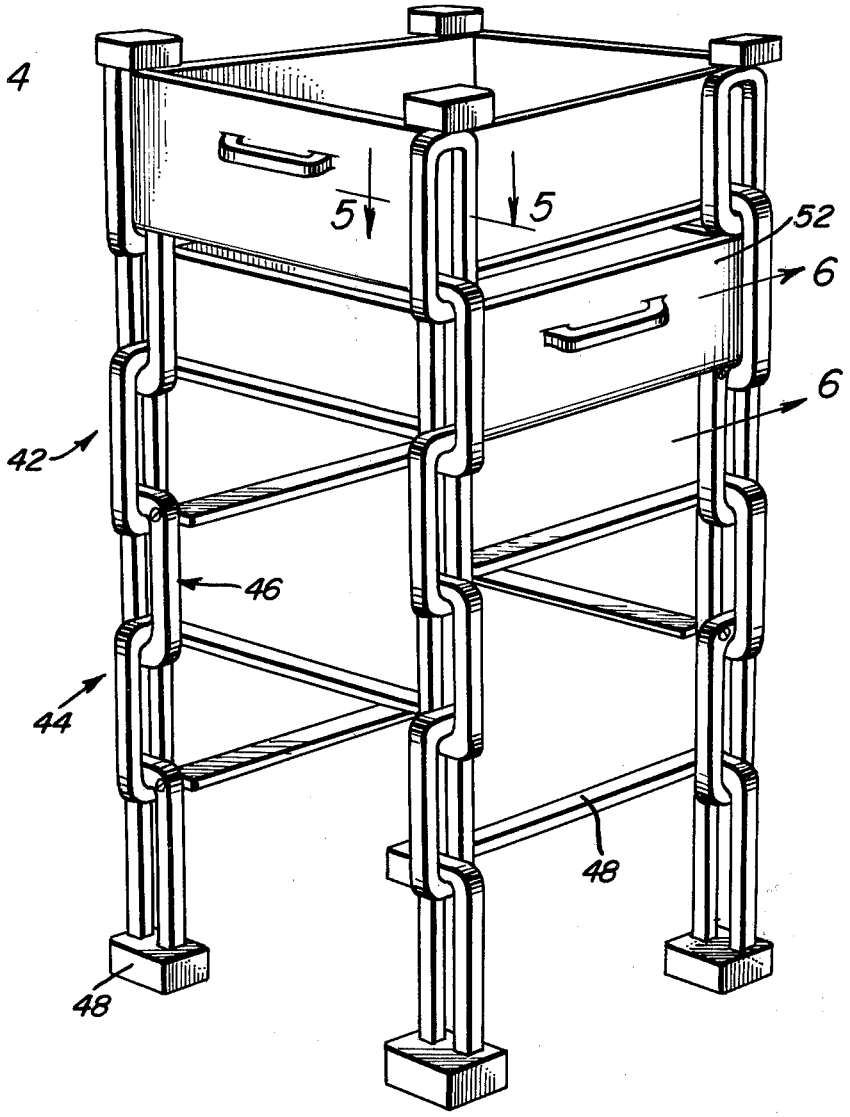
FIG. 4 is a perspective view of another article of furniture constructed in accordance with the present invention.

Referring now to the drawings in detail, FIG. 1 illustrates a typical piece of furniture in the form of a chair 10 constructed in accordance with the present invention. The chair includes a pair of parallel spaced, vertical posts 12 having bearing blocks 14 connected to the lower ends thereof. A pair of parallel spaced legs 16 are also provided, the legs 16 and the posts 12 being interconnected by a pair of parallel spaced, horizontal side frame elements 18 and a pair of parallel spaced front and back frame elements 20. The horizontal frame elements are interconnected with the posts 12 and legs 16 at a selected height to form the support for a seat cushion 22. The posts 12 are also interconnected by a horizontal element 24 spaced above the seat cushion 22 in order to support a backrest cushion 26.

In the illustrated embodiment of FIG. 1, the posts 12, the legs 16, and the horizontal frame pieces 18 and 20 are of similar construction in that they are made from a single piece of material such as a solid or laminated block of wood in the form of link sections 28. Adjacent link sections 28 are aligned with perpendicular planes that intersect along a common longitudinal axis of the vertical column or horizontal frame element. Each link section 28 includes parallel spaced leg portions 30 interconnected at opposite longitudinal ends by bridging portions 32. The lowermost link sections of the posts 12 and legs 16 however, are shorter with the lower bridging portions thereof forming the bearing blocks 14.

Adjacent link sections 28 are integral with each other where the adjacent bridging portions 32 cross so that the link sections form a rigid column or horizontal element. The end link sections of some of the horizontal elements 18 and 24, are somewhat modified in order to accommodate interconnection and assembly between the vertical columns and the horizontal elements. As more clearly seen in FIG. 2, the end link section 28′ of the horizontal element 18 has a separable bridging portion 32′ interconnected with spaced leg portions 30′ by means of the screw fasteners 34. When fastened to its leg portions 30′, the bridging portion 32′ embraces one of the link sections of a vertical leg 16. The horizontal element 18 is thereby connected to the vertical leg 16 and extends horizontally therefrom in perpendicular relationship to the other horizontal element 20 that extends through the link section embraced by the end link section 28′ of the horizontal element 18. An additional fastener 36 as shown by dotted line in FIG. 2, may be employed to secure the bridging portion 32 of the horizontal element 20 to one of the leg portions 30′ of the end link section 28′.

As more clearly seen in FIG. 3, the end link section 28″ associated with the horizontal element 24 extends through one of the link sections of the vertical post 12 in substantial abutment with vertically spaced bridging portions 32 of spaced link sections in the vertical post 12. The leg portions 30″ of the end link section 28″ are interconnected by a separable bridging portion 32″ by means of screw fasteners 38. A decorative end block 40 may be secured to the bridging portion 32′.

Figure 5:
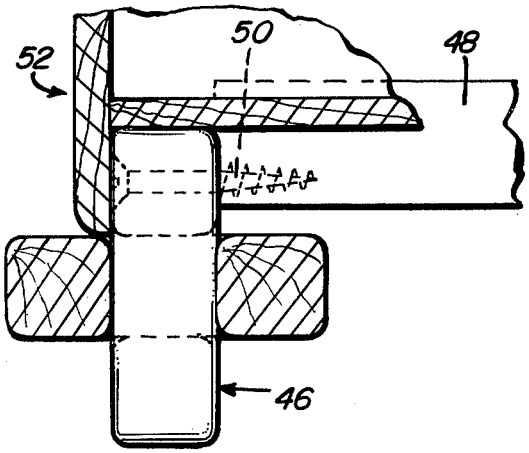
FIG. 5 is an enlarged partial sectional view taken substantially through a plane indicated by section line 5—5 in FIG. 4.
Figure 6:
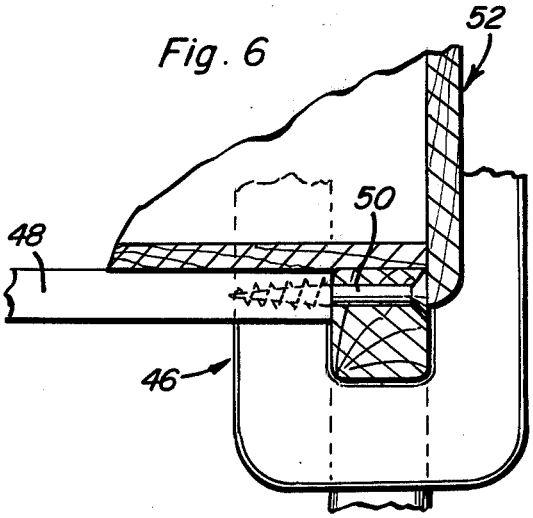
FIG. 6 is an enlarged partial sectional view taken substantially through a plane indicated by section line 6—6 in FIG. 4.

FIG. 4 illustrates another piece of furniture such as a storage chest 42 constructed in accordance with the present invention. The chest 42 includes four vertical columns 44 similar in construction to the vertical posts and legs associated with the chair 10. Thus, each vertical column 44 includes rigidly interconnected link sections 46 with the lowermost link sections being connected to bearing blocks 48. The vertical columns 44 are interconnected in spaced relationship to each other by slide runners 48. The slide runners are interconnected with the vertical columns at selected heights by means of screw fasteners 50 as more clearly seen in FIGS. 5 and 6. Storage drawers 52 are adapted to be slidably mounted between the vertical columns on the slide runners.

Figure 7:
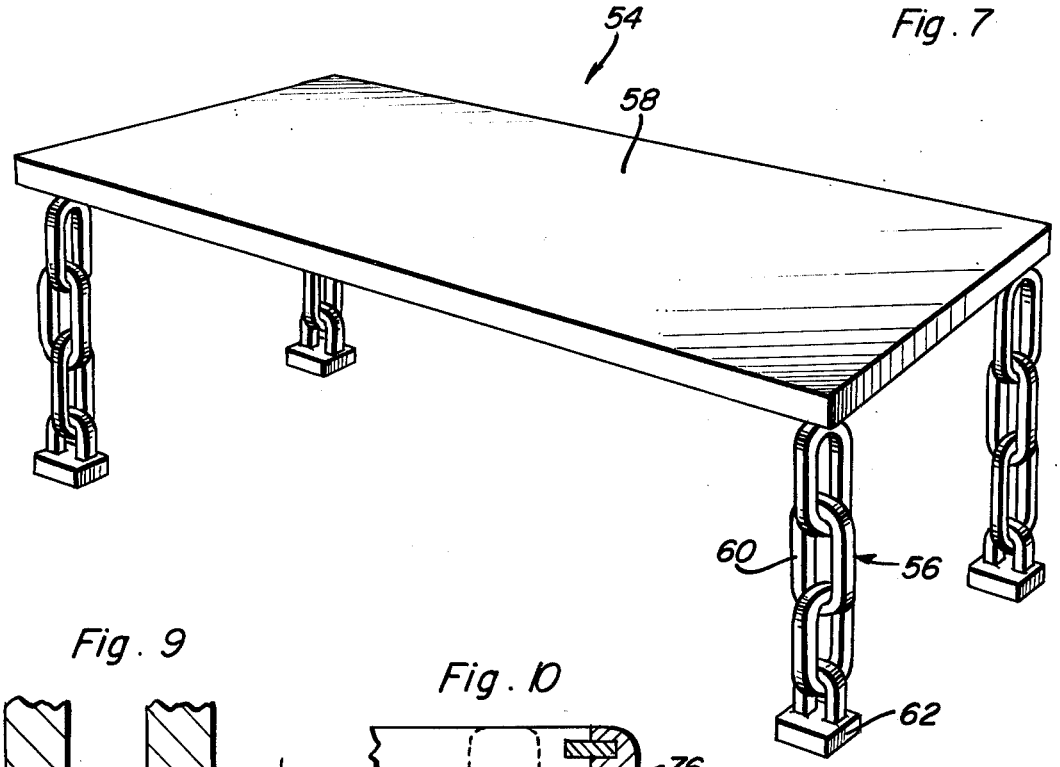
FIG. 7 is a perspective view illustrating a table constructed in accordance with the present invention.

In FIG. 7, a table 54 is shown wherein a plurality of load supporting legs 56 support a horizontal tabletop 58. The vertical legs 56 are also made of rigidly interconnected chain-like link sections 60 as hereinbefore described in connection with FIG. 1. The lowermost link sections of the legs 50 are also provided with bearing blocks 62.

Figure 9:
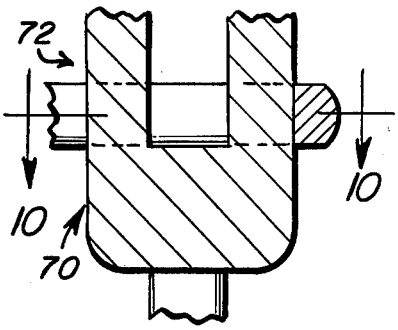
FIG. 9 is an enlarged partial sectional view taken substantially through a plane indicated by section line 9—9 in FIG. 8.
Figure 10:
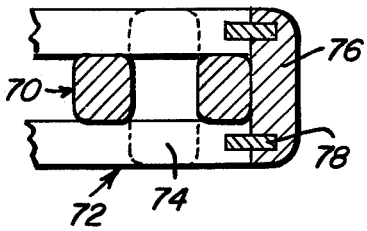
FIG. 10 is a sectional view taken substantially through a plane indicated by section line 10—10 in FIG. 9.
Figure 8:
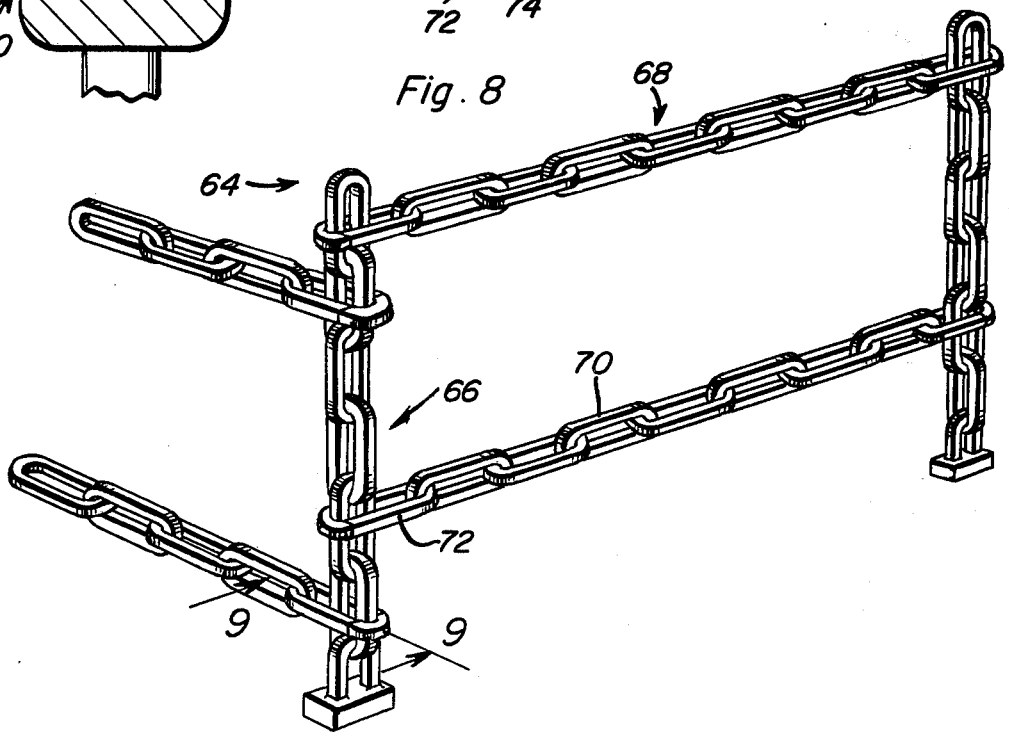
FIG. 8 is a perspective view showing a portion of a fence constructed in accordance with the present invention.

In FIG. 8, a fence assembly 64 is shown wherein a plurality of spaced posts 66 are interconnected by parallel spaced, horizontal rails 68. Both the posts 66 and rails 68 are constructed of rigidly interconnected link sections as hereinbefore described in connection with the other vertical columns. Each of the link sections referred to by reference numeral 70 in FIG. 8 is identical in construction except for the horizontal end link sections 72 by means of which the horizontal rails 68 are interconnected at selected heights to the vertical posts 66. As more clearly seen in FIGS. 9 and 10, the end link sections 72 are provided with parallel spaced leg portions 74 that straddle selected link sections of the vertical posts. A separable bridging portion 76 is interconnected between the ends of the leg portions 74 by means of pegs 78.

Where vertical columns are interconnected with horizontal elements made of the same chain-like link sections, both the vertical columns and horizontal elements may be of the same construction both geometrically and dimensionally. However, dimensionally smaller chain-like link sections may be utilized for the horizontal elements as shown in FIGS. 11 and 12. Thus, relatively large, rigidly interconnected link sections 80 are shown in FIGS. 11 and 12. The end link section 82 of a horizontal element extends through one of the link sections 80 and in abutment with the bridging portions of adjacent link sections 80. The end link section 82 thus includes leg portions 84 that are relatively smaller than the leg portions 86 associated with the link sections 80. The ends of the small leg portions 84 are interconnected with a separable bridging portion 88 by means of fasteners 90. The vertical column and horizontal elements are otherwise similar in construction and arrangement to those hereinbefore described.

It will be apparent from the foregoing description that the chain-like construction of the vertical columns, posts or legs provides for assembly of articles with horizontal elements interconnected with the vertical columns at selected heights. Further, selected widths may be provided for the horizontal elements. Also, assembly of the components of the article being constructed will be facilitated. It will be appreciated that while each of the vertical columns, legs or posts is made of a single unitary piece of material to form a rigid column, the link sections could be separated in order to form an ornamental link chain for the hanging of curtains or lamp fixtures. Any suitable material may be utilized in the one-piece construction of each vertical column such as wood, or plastic.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a load supporting article having a horizontal element interconnected between at least two rigid vertical columns, each of said columns constituted by a single unitary piece of material having a plurality of chain-like link sections, adjacent ones of the link sections being aligned with perpendicular planes intersecting along a common column axis, each of the link sections having spaced leg portions interconnected at opposite longitudinal ends by bridging portions, the bridging portions of the adjacent link sections being integral with each other.

2. The combination of claim 1 including bearing blocks secured to lower ends of the vertical columns.

3. The combination of claim 2 wherein said horizontal element includes a plurality of chain-like link sections geometrically similar to the link sections of the vertical columns except for end link sections at longitudinal ends of the horizontal element, each of said link sections having a separable bridging portion and fastener means securing the separable bridging portion to the leg portions.

4. The combination of claim 3 wherein said vertical columns form the legs of an article of furniture.

5. The combination of claim 1 wherein said vertical columns form the legs of an article of furniture.

6. The combination of claim 1 wherein said horizontal element forms a slide runner.

7. The combination of claim 1 wherein said vertical columns form the posts of a fence.

8. The combination of claim 1 wherein said horizontal element includes a plurality of chain-like link sections geometrically similar to the link sections of the vertical columns except for end link sections at longitudinal ends of the horizontal element, each of said end link sections having a separable bridging portion and fastener means securing the separable bridging portion to the leg portions for holding the columns and horizontal elements assembled.

9. The combination of claim 8 wherein said horizontal element is similar in cross-sectional dimension to the vertical columns.

10. The combination of claim 8 wherein said horizontal element is cross-sectionally smaller than the vertical columns and said end link section extends between the leg portions of one of the link sections of the vertical column abutting spaced bridging portions of adjacent link sections.

11. In a load supporting article having a horizontal element interconnected with a single unitary piece of material constituting a rigid column having a plurality of chain-like link sections, adjacent ones of the link sections being aligned with perpendicular planes intersecting along a common column axis, each of the link sections having spaced leg portions interconnected at opposite longitudinal ends by bridging portions, the bridging portions of the adjacent link sections being integral with each other, and the lower bridging portion of a lowermost of the link sections constituting an integral bearing block.

* * * * *